United States Patent [19]

Kaegi et al.

[11] 4,425,088

[45] Jan. 10, 1984

[54] VANE-STATOR BOTTOM ASSEMBLY FOR ROTARY HYDRAULIC DEVICES

[75] Inventors: Jacob Kaegi, La Celle Saint-Cloud; Daniel Leroy, Limay, both of France

[73] Assignee: Compagnie de Construction Mecanique Sulzer, France

[21] Appl. No.: 303,679

[22] Filed: Sep. 18, 1981

[30] Foreign Application Priority Data

Sep. 19, 1980 [FR] France ..... 80 20208

[51] Int. Cl.[3] ..... F01C 19/00; F04C 27/00

[52] U.S. Cl. ..... 418/147; 418/229

[58] Field of Search ..... 418/147, 148, 228–231, 418/232, 217, 219

[56] References Cited

U.S. PATENT DOCUMENTS 2,436,285 2/1948 Booth ..... 418/219

3,799,710 3/1974 Jacobs ..... 418/147

*Primary Examiner*—Leonard E. Smith

*Assistant Examiner*—Jane E. Obee

*Attorney, Agent, or Firm*—Karl W. Flocks; Sheridan Neimark

[57] ABSTRACT

This invention relates to rotary hydraulic devices of the volumetric or displacement pump type, having a stator and a rotor and vanes axially sliding in the rotor, the stator comprising at least one bottom surface presenting a variable number of recesses therein with ramps and rectilinear zones suited to the operation, said vanes following said bottom surface. In accordance with the invention, the vanes are equipped with an integral or inset base, with end lobes of cylindric shape having a radius of curvature corresponding to that of the milling cutter used for machining the stator. Access to the recesses occurs by means of two ramps corresponding to the lobes of cylindric shape of the vane bases.

6 Claims, 7 Drawing Figures

FIG. 4
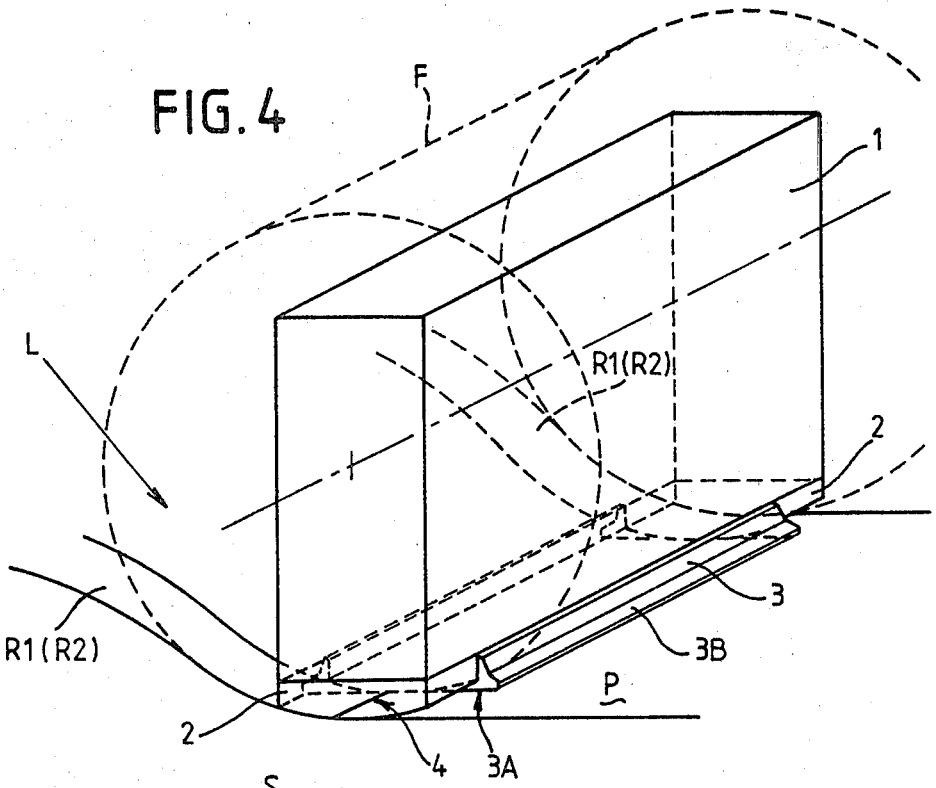
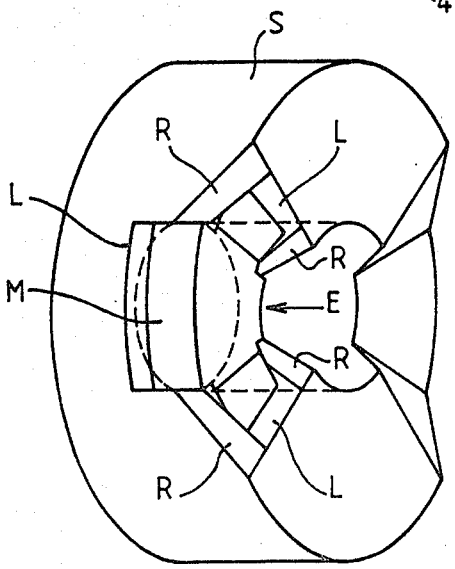
FIG. 1
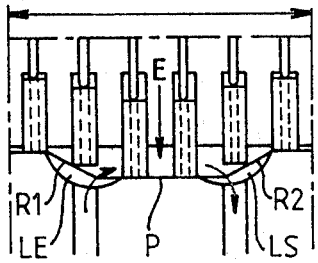
FIG. 2

VANE-STATOR BOTTOM ASSEMBLY FOR ROTARY HYDRAULIC DEVICES

This invention relates to rotary hydraulic devices of the volumetric or displacement pump type, having a stator and a rotor and vanes axially sliding in the rotor.

In the U.S. patent application Ser. No. 277,316 filed on June 25, 1981, the Applicants described a rotary hydraulic device of the volumetric pump type, having coaxial stator and rotor and vanes axially slidable in the rotor, the stator comprising at least one bottom surface having a variable number of deformations with rectilinear zones suited to the operation, or recesses therein, said vanes following said bottom surface, said rotary hydraulic device being characterized in that said recesses are formed on the movable elements of the stator such that the depth of said recesses may be made variable thereby obtaining a variable flow rate with said device.

According to an advantageous form of embodiment, the stator S comprises ramps R on the one hand, and on the other hand, movable stator elements M with recesses E, said ramps and recesses being successively operated for producing constant contact with the whole or a portion of the forward lip of each slidable vane (FIG. 1).

The movable elements M can move in lodgings L formed in the fixed stator portion under the action of an outer mechanical, hydraulic or magnetic control in the stopping position and/or in the course of the operation.

In the U.S. patent application Ser. No. 281,735 filed on July 9, 1981, the Applicants described a hydrostatic motor with vanes axially slidable in rotor lodgings against a continuous recessed stator bottom surface, and comprising a circuit for intercommunication between vanes behind the latter. The vanes are each housed in a lodging formed in a rotor opposite a stator bottom S comprising recesses therein of which one E comprises, with respect to an interstitial plane between rotor and stator and with respect to a rotor motion, a ramp R1 geometrically deviating from said plane, an area P parallel to said plane and a ramp R2 geometrically coming closer to said plane. Each recess E comprises a fluid inlet passage LE and a fluid outlet passage LS (FIG. 2).

The hydraulic motor with axial vanes requires the manufacturing of trapezoidal vanes P, due to the requisite linear contact between the base of the vanes and the face of the stator in the access ramps to the recesses. The contacting generatrices G are oriented towards the center of rotation and parallel to one another (FIG. 3).

The machining of such a stator cannot be effected with a circumferential motion, cylindric, milling cutter. The rational method results in geometric deficiencies and the contacting generatrices are no longer parallel to one another.

The present invention is intended for remedying this problem and facilitating the manufacturing of vanes, rotor and stator and moreover, improving the strength of vanes to wear and shocks.

In accordance with the invention, the vanes are equipped with an integral or inset base, with end lobes of cylindric shape having a radius of curvature corresponding to that of the milling cutter used for machining the stator. Access to the recesses occurs by means of two ramps corresponding to the lobes of cylindric shape of the vane bases.

During its motion the vane is perfectly engaged with the stator and its motion corresponds to that of the cylindric machining cutter.

The lobes of cylindric shape of the bases are also intended for absorbing the heave of the end of travel due to acceleration of the vane caused by its downward or upward motion in the stator recess.

The portion of the base located between the two lobes of cylindric shape consists of two opposite lips, with a flat contacting part of said lips and a generatrix of the cylindric lobes being in the same plane. The object of the lips is to provde for the tightness and application of the vanes in the flat active zones of the stator.

Since the base of the vane corresponds to the stator geometry, it is no longer necessary to make the body of the vane trapezoidal. The parallelepipedic shape facilitates the manufacturing of the vanes and the lodgings in the rotor.

Other characteristics and advantages of this invention will appear from the following description with reference to the attached drawings, in which:

FIG. 1 is a perspective view of a stator element according to U.S. patent application Ser. No. 277,316;

FIG. 2 is a developed view of a hydrostatic motor showing a stator bottom recess in a phase of operation according to U.S. patent application Ser. No. 281,735;

FIG. 4 is a perspective view showing a vane according to the invention in relation to ramps and a stator bottom zone;

Figure 3:
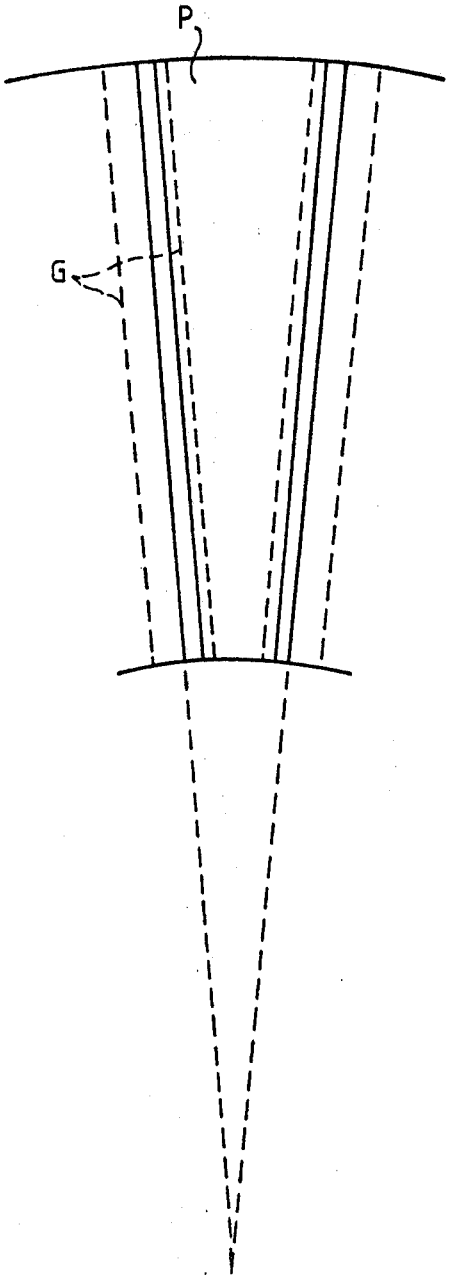
FIG. 3 is a schematic view showing a trapezoidal vane for hydraulic motor with axially slidable vanes.
Figure 5:
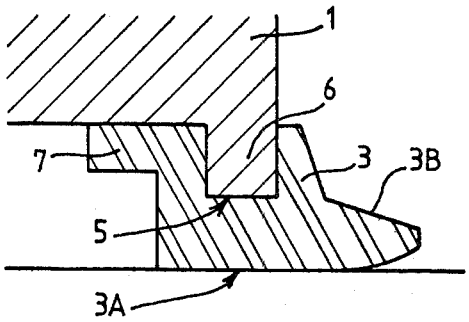
FIG. 5 is a sectional view of a vane lip according to the invention.
Figure 6:
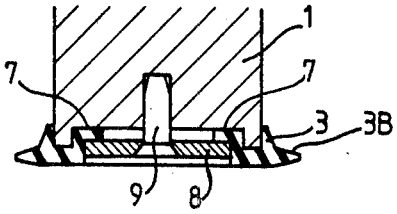
FIG. 6 is a partly sectional view showing the mounting of the two longitudinal vane lips according to the invention.

In the form of embodiment represented in FIGS. 4 to 6, a vane 1 according to the invention of a generally parallelepipedic shape comprises an integral or inset base having the characteristic of comprising two end lobes 2 of cylindric shape having a radius of curvature corresponding to that of the milling cutter F used for machining the stator bottom surface with ramps R and zones P, on the one hand, and on the other hand, longitudinal lips 3 having a bottom portion 3A engageable on said zones to obtain tightness and application of the vane. It is to be noted that a generatrix 4 of the cylindric end lobes 2 lies in the plane corresponding to that of the bottom portions 3A.

The lips 3 of the vane can also move totally or partly in passages L provided between the pairs of ramps R1 or R2, during the rotor motion.

The lips 3 are preferably made of a material having specific elasticity which is used advantageously for improving their contact against the active zones of the stator bottom surface. Such material may obviously be natural or synthetic.

Each lip has a compensating portion 3B exposed to the pressure of fluid so that said pressure is exerted substantially perpendicular to the stator surface, thereby improving the application of the vane against the stator surface.

In the form of embodiment shown more particularly in FIGS. 5 and 6, each lip is hollowed out to form a groove 5 providing for the mounting thereof on a corresponding rib 6 of the vane and comprises a flange portion 7 to permit the blocking thereof against the vane by means of a plate 8 (FIG. 6) and threaded bolts 9 of which only one is shown schematically in FIG. 6.

Figure 7:
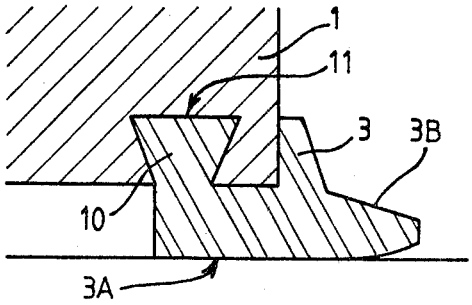
FIG. 7 is a sectional view of an alternative form of embodiment of a vane lip according to the invention.

In the form of embodiment shown in FIG. 7, each lip 3 comprises a dovetail rib 10 slidable in a corresponding groove 11 formed in the vane. This type of mounting permits to avoid the fixation plate 8 with the threaded bolt 9.

It will be understood that the present invention was only described and represented with reference to a preferential form of embodiment and that equivalent parts can be substituted for its constitutive elements without departing from the scope thereof which is defined in the appended claims.

We claim:

1. A vane-stator bottom assembly for rotary hydraulic devices of the volumetric pump type with coaxial stator and rotor and axially slidable vanes in the rotor, the stator comprising at least one bottom surface having a variable number of recesses therein with ramps and rectilinear zones suited to the operation, said vanes following said bottom surface, wherein said stator bottom is machined with a circumferential motion cylindric milling cutter and said vane comprises a cylindric base for contacting said ramps of said stator bottom according to a radius of curvature corresponding to that of the milling cutter used for machining said stator bottom, and tightness and application lips against said rectilinear zones of said stator bottom, and said vane comprises two opposite tightness and application lips having a flat contacting portion, said base of said vane presenting a cylindric contacting generatrix, said flat contacting portion of said lips and said cylindric contacting generatrix of said base being in one and the same plane.

2. A vane-stator bottom assembly for rotary hydraulic devices of the volumetric pump type with coaxial stator and rotor and vanes slidable axially in the rotor, the stator comprising at least one bottom surface having a variable number of recesses with ramps and rectilinear zones suited to the operation, said vanes following said bottom surface, each of said ramps being formed with a central passage thereby to constitute a portion of two similar ramps, wherein said stator bottom is machined with a circumferential motion cylindric milling cutter and said vane comprises a cylindric base for contacting said ramps of said stator bottom according to a radius of curvature corresponding to that of the milling cutter used for machining said stator bottom, and tightness and application lips against said rectilinar zones of said stator bottom said vane of parallelpipedic shape comprising two opposite tightness and application lips having a flat contacting portion, said base of said vane presenting a cylindric contacting generatrix, said flat contacting portion of said lips and said cylindric contacting generatrix of said base being in one and the same plane, said tightness and application lips of said vane finding their way in said central passage during the rotor motion, said base having two end lobes, with the cylindric contact of said base with said ramps being then provided by said two end lobes thereby improving the strength of the vanes to wear and shocks.

3. A vane-stator bottom assembly for rotary hydraulic devices of the volumetric pump type with coaxial stator and rotor and vanes slidable axially in the rotor, the stator comprising at least one bottom surface having a variable number of recesses with ramps and rectilinear zones suited to the operation, said vanes following said bottom surface, wherein said stator bottom is machined with a circumferential motion cylindric milling cutter and said vane comprises a cylindric base for contacting said ramps of said stator bottom according to a radius of curvature corresponding to that of the milling cutter used for machining said stator bottom, and tightness and application lips against said rectilinear zones of the stator bottom, said vane comprising two opposite tightness and application lips having a flat contacting portion, said base of said vane having a cylindric contacting generatrix, said flat contacting portion of said lips and said cylindric contacting generatrix of said base being in one and the same plane, and each of said lips having a compensating portion exposed to fluid pressure, such that said pressure can be exerted substantially perpendicular to said stator surface.

4. A vane-stator bottom assembly for rotary hydraulic devices of the volumetric pump type with coaxial stator and rotor and vanes slidable axially in the rotor, the stator comprising at least one bottom surface having a variable number of recesses therein with ramps and rectilinear zones suited to the operation, said vanes following said bottom surface, wherein said stator bottom is machined with a circumferential motion cylindric milling cutter and said vane comprises a cylindric base for contacting said ramps of said stator bottom, according to a radius of curvature corresponding to that of the milling cutter used for machining said stator bottom, and tightness and application lips against said rectilinear zones of the stator bottom, said vane comprising two opposite tightness and application lips having a flat contacting portion, said base of said vane having a cylindric contacting generatrix, said flat contacting portion of said lips and said cylindric contacting generatrix of said base being in one and the same plane, and each of said lips being made of a material having specific elasticity.

5. A vane-stator bottom assembly for rotary hydraulic devices of the volumetric pump type with coaxial stator and rotor and vanes slidable axially in the rotor, the stator comprising at least one bottom surface having a variable number of recesses with ramps and rectilinear zones suited to the operation, said vanes following said bottom surface, wherein said stator bottom is machined with a circumferential motion cylindric milling cutter and said vane comprises a cylindric base contacting said ramps of said stator bottom according to a radius of curvature corresponding to that of the milling cutter used for machining said stator bottom, and tightness and application lips against said rectilinear zones of said stator bottom, said vane comprising two opposite tightness and application lips having a flat contacting portion, said base of said vane having a cylindric contacting generatrix, said flat contacting portion of said lips and said cylindric contacting generatrix of said base being in one and the same plane, and wherein a groove is hollowed out in each of said lips and a corresponding rib is formed in said vane, said rib being received in said groove, and wherein clamping means and an inner flange portion of each of said lips provide for the fixation thereof against said vane.

6. A vane-stator bottom assembly for rotary hydraulic devices of the volumetric pump type with coaxial stator and rotor and vanes axially slidable in the rotor, the stator comprising at least one bottom surface having a variable number of recesses therein with ramps and rectilinear zones suited to the operation, said vanes following said bottom surface, wherein said stator bottom is machined with a circumferential motion cylindric milling cutter, and wherein said vane comprises a cylindric base for contacting said ramps of said stator bottom according to a radius of curvature corresponding to that of the milling cutter used for machining said stator bottom, and tightness and application lips against said rectilinear zones of said stator bottom, said vane comprising two opposite tightness and application lips having a flat contacting portion, said base of said vane having a cylindric contacting generatrix, said flat contacting portion of said lips and said cylindric contacting generatrix of said base being in one and the same plane and wherein a groove is hollowed in each of said lips and a corresponding rib is formed in each of said vanes, said rib being received in said groove, and said rib being a dovetail rib and said groove being a mating groove provided in said vane.

* * * * *